US009028245B2

(12) United States Patent
Fan et al.

(10) Patent No.: US 9,028,245 B2
(45) Date of Patent: May 12, 2015

(54) AUTOMATED SETUP PROCESS FOR METERED COMBUSTION CONTROL SYSTEMS

(75) Inventors: Junqiang Fan, Glastonbury, CT (US); Muhidin A. Lelic, Cary, NC (US)

(73) Assignee: UTC Fire & Security Corporation, Farmington, CT (US)

( * ) Notice: Subject to any disclaimer, the term of this patent is extended or adjusted under 35 U.S.C. 154(b) by 354 days.

(21) Appl. No.: 13/127,367

(22) PCT Filed: Nov. 25, 2008

(86) PCT No.: PCT/US2008/084696

§ 371 (c)(1),
(2), (4) Date: May 3, 2011

(87) PCT Pub. No.: WO2010/062286

PCT Pub. Date: Jun. 3, 2010

(65) Prior Publication Data

US 2011/0212404 A1 Sep. 1, 2011

(51) Int. Cl.

| | |
|---|---|
| ***F23N 1/02*** | (2006.01) |
| ***F23N 5/00*** | (2006.01) |
| ***F23N 1/08*** | (2006.01) |

(52) U.S. Cl.

CPC ..... *F23N 1/022* (2013.01); *F23N 1/082* (2013.01); *F23N 5/006* (2013.01); *F23N 2023/44* (2013.01); *F23N 2025/18* (2013.01); *F23N 2025/19* (2013.01); *F23N 2027/20* (2013.01); *F23N 2033/08* (2013.01); *F23N 2035/06* (2013.01); *F23N 2035/14* (2013.01); *F23N 2037/26* (2013.01); *F23N 2041/04* (2013.01)

(58) Field of Classification Search

CPC ..... F23N 2023/44; F23N 2027/20; F23N 2900/05001; F23N 5/006

USPC ..... 431/12, 7, 4, 89, 153, 2, 115, 76

See application file for complete search history.

(56) References Cited

U.S. PATENT DOCUMENTS

| | | | | |
|---|---|---|---|---|
| 4,133,629 | A | 1/1979 | Clark | |
| 4,474,549 | A | 10/1984 | Capone | |
| 4,492,559 | A * | 1/1985 | Pocock | 431/12 |
| 4,509,912 | A * | 4/1985 | VanBerkum | 431/76 |
| 4,531,905 | A * | 7/1985 | Ross | 431/12 |
| 4,576,570 | A * | 3/1986 | Adams et al. | 431/12 |

(Continued)

FOREIGN PATENT DOCUMENTS

| | | |
|---|---|---|
| JP | 62238921 | 10/1987 |

OTHER PUBLICATIONS

International Preliminary Report on Patentability issued May 31, 2011, 6 pgs.

(Continued)

*Primary Examiner* — Avinash Savani
*Assistant Examiner* — Vivek Shirsat
(74) *Attorney, Agent, or Firm* — Cantor Colburn LLP

(57) ABSTRACT

A method is provided for the automated setup of a metered combustion control system for controlling operation of a boiler combustion system. The automated setup process includes both commissioning and controller tuning, rather than tuning the carbon monoxide and/or oxygen trim controller after the commissioning process has been completed. The oxygen trim controller or the carbon monoxide trim controller is used to identify the air/fuel ratio.

5 Claims, 4 Drawing Sheets

(56) References Cited

U.S. PATENT DOCUMENTS

| | | | | |
|---|---|---|---|---|
| 4,586,893 | A * | 5/1986 | Somerville et al. | 431/76 |
| 4,645,450 | A * | 2/1987 | West | 431/12 |
| 4,676,734 | A * | 6/1987 | Foley | 431/12 |
| 4,836,166 | A | 6/1989 | Wietelmann | |
| 5,190,454 | A * | 3/1993 | Murray et al. | 432/103 |
| 5,310,335 | A * | 5/1994 | van Berkum | 431/12 |
| 5,865,611 | A * | 2/1999 | Maiello | 431/12 |
| 5,880,411 | A | 3/1999 | Gillespie et al. | |
| 5,924,859 | A * | 7/1999 | Nolte et al. | 431/12 |
| 5,997,280 | A * | 12/1999 | Welz et al. | 431/90 |
| 6,024,561 | A | 2/2000 | Kemp et al. | |
| 6,206,687 | B1 | 3/2001 | Redington | |
| 6,247,919 | B1 * | 6/2001 | Welz et al. | 431/13 |
| 6,481,427 | B1 * | 11/2002 | Javaherian | 123/673 |
| 6,918,356 | B2 | 7/2005 | Rowe et al. | |
| 7,090,486 | B2 * | 8/2006 | Lochschmied | 431/25 |
| 7,241,135 | B2 * | 7/2007 | Munsterhuis et al. | 431/12 |
| 7,985,066 | B2 * | 7/2011 | Chian et al. | 431/19 |
| 2003/0054303 | A1 | 3/2003 | Abbasi et al. | |
| 2008/0266120 | A1 * | 10/2008 | Leeland et al. | 340/578 |
| 2009/0142717 | A1 * | 6/2009 | Lavelle | 431/12 |
| 2009/0183660 | A1 * | 7/2009 | Wessel | 110/188 |

OTHER PUBLICATIONS

International Search Report and Written Opinion mailed Jan. 27, 2009, 10 pgs.

Model based O2 Trim Controller Tuning Method during Commissioning Statge, Distributed on Oct. 14, 2008, 4 pgs.

* cited by examiner

AUTOMATED SETUP PROCESS FOR METERED COMBUSTION CONTROL SYSTEMS

FIELD OF THE INVENTION

This invention relates generally to natural gas and oil fired boilers and, more particularly, to the setup of metered combustion control systems for industrial and commercial natural gas and oil fired, steam/hot water boilers.

BACKGROUND OF THE INVENTION

Metered combustion control systems are commonly employed in connection with industrial and commercial boilers for modulating air flow and fuel flow to the burner or burners of the boiler. One type of combustion controller uses air flow and fuel flow actuators to modulate air flow and fuel flow through parallel metering of flows over the entire operating range of the boiler to ensure the safety, efficiency, and environmental requirements of combustion can be satisfied across the entire operating range. In parallel metering control systems, the firing rate demand signal is applied in parallel as the setpoint to two slave flow control loops. One flow control loop monitors fuel flow and the other monitors air flow. The air flow controller controls air flow by manipulating actuators associated with an air damper and/or a variable frequency driver operatively associated with a variable speed air flow fan. The fuel flow controller controls fuel flow by manipulating a fuel actuator, such as a solenoid valve or other type of flow servo valves. The two flow controllers' setpoints are coordinated by an air/fuel flow ratio at the desired firing rate.

The operating range of a boiler is generally defined by its firing range between a low fire point commensurate with the minimum firing rate at which combustion is sustainable and a high fire point commensurate with the maximum energy output of the burner. The firing range depends on the boiler's burner's turndown ratio, that is, the ratio between the highest energy output and the lowest energy output. At each given firing rate within the boiler firing range, a suitable air/fuel flow ratio must be defined, which in turns determines efficiency, emissions and stability of combustion. The determined set of air/fuel flow ratios provides the setpoints for the two flow control loops that is used by the boiler controller during operation of the boiler to modulate the burner fuel valve and the air damper in response to firing rate.

When a combustion control system is first installed on a boiler, the desired air/fuel flow ratios need to be defined at a number of points, i.e. firing rates, within the firing range, because the relationship between the sets of air/fuel flow ratios and firing rates is non-linear. The process of defining the proper air/fuel flow ratios throughout the firing range is commonly referred to as commissioning of the boiler combustion control system. The purpose of the commissioning process is to find a set of coordinated air and fuel flow setpoints (i.e. air/flow ratios) at various points, i.e. firing rates, across the operating range such that safety, efficiency, and environmental requirements can be achieved. During the commissioning process, at each of the respective firing rates at which an optimal set coordinated air and fuel flows is determined, the excess oxygen level and carbon monoxide level associated with combustion at those positions are measured and recorded. Typically, the commissioning process is manually done by a technician and it can be very time consuming.

Generally, the combustion controller includes a first feedback circuit including a pressure controller for adjusting the firing rate in response to a sensed boiler pressure and a second feedback circuit including an oxygen trim controller for adjusting the excess oxygen level in response to the sensed excess oxygen in the flue gas. Typically, the pressure controller and the oxygen trim controller are of the type commonly referred to PID controllers. Such controllers employ a control function having a proportional term, an integral term and a differential term. In conventional practice, once the commissioning process is completed, it is necessary for the commissioning technician to separately tune the oxygen trim controller and the pressure controller through trial and error method or further step tests. The purpose of the tuning process is to establish the gain factors associated with the proportional, integral and differential terms of the control function to provide a control function that is applicable over the entire firing range of the associated combustion system. The tuning of both controllers through further tests after completion of the commissioning process lengthens the time required for a technician to complete installation of the combustion control system.

SUMMARY OF THE INVENTION

A method is provided for the automated setup of a metered combustion control system for controlling operation of a boiler combustion system having a burner, a fuel flow control device and a fuel flow control device controller operatively associated with said fuel flow control device for supplying fuel to said burner and an air flow control device and an air flow control device controller operatively associated with said air flow control device for supplying air to said burner. The automated setup method includes identifying a lower limit air/fuel mass flow ratio and an upper limit air/fuel mass flow ratio through a negative feedback control method at a plurality of selected firing rate points between a minimum firing rate and a maximum firing rate, calculating a set point air/fuel ratio as the average of the lower limit air/fuel ratio and the upper limit air/fuel ratio at each selected firing rate point of the plurality of selected firing rate points, developing a relationship between the average air/fuel ratio and firing rate between the minimum firing rate and the maximum firing rate, and tuning the air flow controller and the fuel flow controller, the oxygen trim or carbon monoxide trim controller. The negative feedback control method used in identifying a lower limit air/fuel mass flow ratio and an upper limit air/fuel mass flow ratio at each selected firing rate point may include a carbon monoxide trim control loop and/or an excess oxygen trim control loop.

In an embodiment, the step of identifying a lower limit air/fuel mass flow ratio and an upper limit air/fuel mass flow ratio through a negative feedback control method at a plurality of selected firing rate points between a minimum firing rate and a maximum firing rate includes identifying a minimum and a maximum air flow rate setpoint at each selected firing rate at a respective selected fuel flow control device controller setting associated with said each selected firing rate. In an embodiment, the step of identifying a lower limit air/fuel mass flow ratio and an upper limit air/fuel mass flow ratio through a negative feedback control method at a plurality of selected firing rate points between a minimum firing rate and a maximum firing rate comprises identifying a minimum and a maximum fuel flow rate setpoint at each selected firing rate at a respective selected air flow control device controller setting associated with said each selected firing rate.

In one aspect, the automated setup method includes the steps of: (a) selecting a firing rate point between the minimum firing rate and the maximum firing rate; (b) at a initial setting of the fuel flow control device controller associated with the selected firing rate point, selecting a first setting of the air flow control device controller and incrementally resetting the air flow control device controller; (c) operating the burner at the selected firing rate point at each air flow control device controller setting in step (b) to generate a flue gas and measuring at each air flow control device controller setting: the mass air flow, the oxygen content in the flue gas, and the carbon monoxide content in the flue gas; (d) identifying and saving a lower limit air/fuel ratio at the selected firing rate at which the measured carbon monoxide content in the flue gas is equal to an upper limit carbon monoxide target level; (e) identifying and saving an upper limit air/fuel ratio at the selected firing rate at which the measured carbon monoxide content in the flue gas is equal to a lower limit carbon monoxide target level; (f) repeating steps (a) through (e) at a plurality of selected firing rate points between a minimum firing rate and a maximum firing rate; and (g) calculating a set point air/fuel ratio as the average of the lower limit air/fuel ratio and the upper limit air/fuel ratio at each selected firing rate point of the plurality of selected firing rate points and developing a relationship between the average air/fuel ratio and firing rate between the minimum firing rate and the maximum firing rate.

The method may include the further steps of: comparing the measured oxygen content at the air flow control device controller setting at which the measured carbon monoxide content in the flue gas is equal to an upper limit carbon monoxide target level to a lower limit oxygen target level; if the measured oxygen content is less than the lower limit oxygen target level, incrementally resetting the air flow control device controller setting until the measured oxygen content exceeds the lower limit oxygen target level; and identifying and saving the air/fuel ratio at the air flow control device controller setting until the measured oxygen content first exceeds the lower limit oxygen target level as the lower limit air/fuel ratio at the selected firing rate point.

In one aspect, the setup method includes the steps of: (a) selecting a first firing rate point; (b) at a initial setting of the fuel flow control device controller associated with the selected firing rate point, selecting a first setting of the air flow control device controller and incrementally resetting the air flow control device controller; (c) operating the burner at the selected firing rate point at each air flow control device controller setting in step (b) to generate a flue gas and measuring at each air flow control device controller setting: the mass air flow, the oxygen content in the flue gas, and the carbon monoxide content in the flue gas; (d) identifying at the selected firing rate: a model relating: the air mass flow to the air flow control device controller setting, a model relating the oxygen content in the flue gas to the air flow control device controller setting, and a model relating the carbon monoxide content in the flue gas to the air flow control device controller setting; (e) calculating a set of control parameters for an air mass flow rate feedback loop controller, for a oxygen trim feedback loop controller, and for a carbon monoxide feedback loop controller; (f) resetting the air flow control device controller at the first setting and incrementally resetting the fuel flow control device controller; (g) measuring the fuel mass flow at each fuel flow control device controller setting in step (f) and identifying a model relating the fuel flow mass to the fuel flow control device controller setting; (h) calculating a set of control parameters for a fuel mass flow rate feedback loop controller; (i) selecting a new firing rate point; (j) at a initial setting of the fuel flow control device controller associated with the selected firing rate point, selecting a first setting of the air flow control device controller and incrementally resetting the air flow control device controller; (k) operating the burner at the selected firing rate point at each air flow control device controller setting in step (b) to generate a flue gas and measuring at each air flow control device controller setting: the mass air flow, the oxygen content in the flue gas, and the carbon monoxide content in the flue gas; (l) identifying and saving a lower limit air/fuel ratio at the selected firing rate at which the measured carbon monoxide content in the flue gas is equal to an upper limit carbon monoxide target level; (m) identifying and saving an upper limit air/fuel ratio at the selected firing rate at which the measured carbon monoxide content in the flue gas is equal to a lower limit carbon monoxide target level; (n) repeating steps (i) through (m) at a plurality of selected firing rate points between a minimum firing rate and a maximum firing rate; and (o) calculating a set point air/fuel ratio as the average of the lower limit air/fuel ratio and the upper limit air/fuel ratio at each selected firing rate point of the plurality of selected firing rate points and developing a relationship between the average air/fuel ratio and firing rate between the minimum firing rate and the maximum firing rate.

In an aspect of the method, the steps of identifying a lower limit air/fuel ratio and an upper limit air fuel ratio at each selected firing rate includes using a negative feedback control loop to identify the maximum and minimum air flow setpoint at each selected firing rate. In a further aspect of the method, the negative feedback control loop may comprise a carbon monoxide trim control loop or an excess oxygen trim control loop. In a further aspect of the method, the includes the step of selectively activating one of a negative feedback oxygen trim control and a negative feedback carbon monoxide trim control for use in identifying the maximum and minimum air flow setpoint at each firing rate.

A metered combustion control system is also provided for controlling operation of a boiler combustion system having a burner, a fuel flow control device and a fuel flow control device controller operatively associated with said fuel flow control device for supplying fuel to said burner and an air flow control device and an air flow control device controller operatively associated with said air flow control device for supplying air to said burner; said control system comprising an oxygen trim feedback loop, a carbon monoxide trim feedback loop, and a switching device for selectively activating one of the oxygen trim controller or the carbon monoxide trim controller. The oxygen trim feedback loop may comprise a negative feedback loop. The carbon monoxide trim feedback loop may comprise a negative feedback loop.

BRIEF DESCRIPTION OF THE DRAWINGS

For a further understanding of the invention, reference will be made to the flowing detailed description of the invention which is to be read in connection with the accompanying drawing, wherein.

DETAILED DESCRIPTION OF THE INVENTION

Figure 1:
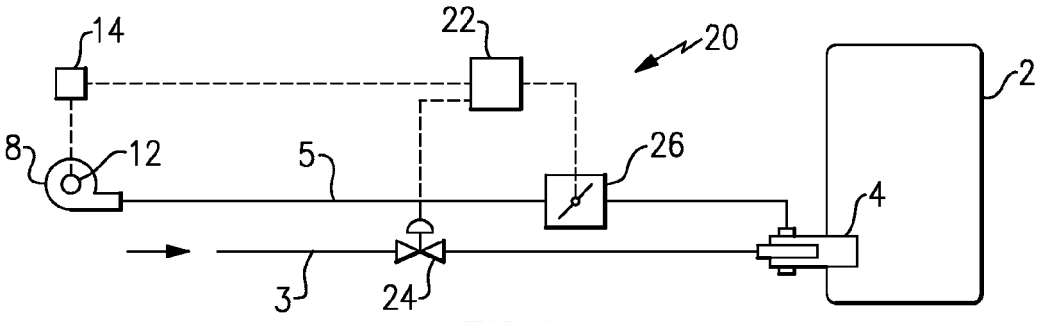
FIG. 1 is a schematic diagram of a combustion system for a steam/hot water boiler.

Referring now to FIG. 1, there is depicted a block diagram representing a combustion control system 20 for controlling fuel flow and air flow to a burner 4 of a hot water or steam boiler 2. In operation, the control system 20 functions to maintain safe, efficient and environmental acceptable operation at any particular firing rate. The combustion control system 20 includes a fuel flow control device 24, typically a servo-valve, disposed in a fuel supply line 3 to the burner 4 to control the amount of flow supplied to the burner. The combustion control system 20 also includes an air flow control device, such as, for example, a damper 26 disposed in an air supply duct 5 to the burner 4, to control the amount of airflow supplied by the fan 8 to the burner. Alternatively, the fan 8 may be a variable speed fan driven by a variable speed motor 12, the speed of which may be controlled by a variable frequency drive 14. In this embodiment, the air flow control device comprises the variable frequency drive 14 whereby the speed of the motor/fan may be varied to selectively increase or decrease the volume of air flow through the supply duct 5 to the burner 4. The combustion control system 20 further includes a controller 22 operatively associated with the fuel flow control device 24 for selectively manipulating the fuel flow control device 24 and with the air flow control device, whether a damper 26 or a variable frequency drive 14, for selectively manipulating the air flow control device.

Figure 2:
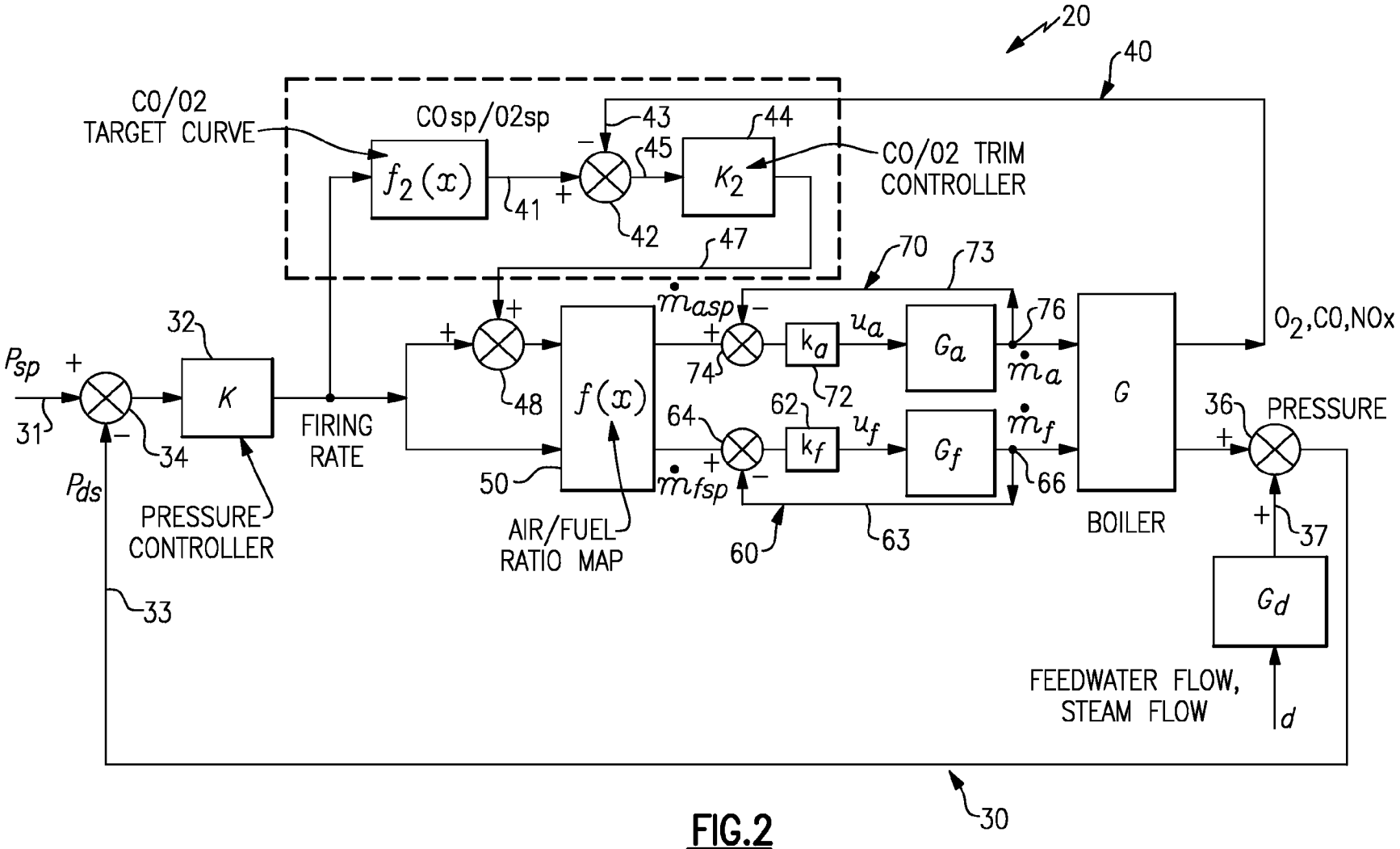
FIG. 2 is a block diagram of an exemplary embodiment of a metered combustion control system with carbon monoxide/oxygen trim control.

Referring now to FIG. 2, the combustion control system 20 depicted therein is an exemplary embodiment of a conventional dynamic feedback control in accord with the invention. The combustion control system 20 includes a boiler steam pressure (or hot water temperature for a hot water boiler) control feedback loop 30, a carbon monoxide/oxygen ($CO/O_2$) level control feedback loop 40, an air/fuel ratio map 50, a fuel flow control feedback loop 60, and an air flow feedback loop 70. In FIG. 2, $\dot{m}_a$ represents the air mass flow rate and $\dot{m}_f$ represents the fuel mass flow rate. $G_a$ represents the air servo transfer function, $G_f$ represents the fuel servo transfer function, G represents the boiler transfer function, and $G_d$ represents the boiler water-side transfer function. K represents the boiler pressure controller 32, $K_a$ represents the air flow mass rate controller 72, $K_f$ represents the fuel flow mass rate controller 62, and $K_2$ represents the carbon monoxide/oxygen level controller 44. The function f(x) represents an air/fuel ratio curve, which is a non-linear function relating air/fuel ratio to firing rate. This function provides the setpoints to the air flow control loop 70 and the fuel flow control loop 60. Additionally, $f_2(x)$ represents an excess oxygen target curve or a carbon monoxide target curve, which may be a load dependent (nonlinear) function relating set point oxygen content target values to firing rate.

The air servo transfer function, $G_a$, converts an air servo position, $u_a$, inputted to the air flow control damper 26 to a corresponding air mass flow rate, $\dot{m}_a$. The fuel servo transfer functions, $G_f$, coverts a fuel servo function, $u_f$, inputted to the fuel flow control device 24 to a corresponding fuel mass flow rate, $\dot{m}_f$. The boiler transfer function, G, models the boiler fire-side operation and provides as output, a boiler steam pressure and flue gas excess oxygen content for an inputted fuel mass flow rate and an inputted air mass flow rate. The boiler water-side transfer function, $G_d$, translates an input change in a boiler water-side parameter, such as boiler water level, feed water mass flow rate, and/or steam (hot water) mass flow rate into a boiler pressure change.

The boiler feedback loop 30 includes a boiler pressure controller 32 that adjusts the burner firing rate in response to a change in one or more operating parameters impacting boiler steam pressure (hot water temperature) in order to maintain a desired set point pressure. The boiler pressure controller 32 receives as input a signal indicative of the change in the boiler steam pressure (hot water temperature) from a negative feedback circuit 34 attendant to a change in one or more water-side operating parameters, such as boiler water level, boiler feedwater mass flow rate, and boiler steam (hot water) mass flow rate, or a change in a fire-side operating parameter, such as fuel mass flow rate or air mass flow rate, reflected in a signal output from the addition circuit 36.

The fuel flow control feedback loop 60 includes a fuel mass flow rate controller 62, a negative feedback circuit 64 and a fuel mass flow sensor 66. The feedback circuit 64 receives a set point fuel mass flow rate, $m_{fsp}$, from the controller 22 and a negative feedback signal 63 from the fuel mass flow rate sensor 66 indicative of a sensed fuel flow mass rate. The feedback circuit 64 process that input and outputs an adjusted fuel mass flow rate set point signal to the fuel mass flow rate controller 62 which generates and transmits a positioning signal to the fuel flow servo, which through application of the transfer function, $G_f$, positions the fuel flow control device 24 as appropriate to provide the desired fuel mass flow rate.

The air flow control feedback loop 70 includes an air mass flow rate controller 72, a negative feedback circuit 74 and an air mass flow sensor 76. The feedback circuit 74 receives a set point air mass flow rate, $m_{asp}$, from the controller 22 and a negative feedback signal 73 from the air mass flow rate sensor 76 indicative of a sensed air mass flow rate. The feedback circuit 74 process that input and outputs an adjusted air mass flow rate set point signal to the air mass flow rate controller 72 which generates and transmits a positioning signal to the air flow servo, which through application of the transfer function, $G_a$, positions the air flow control device 26 as appropriate to provide the desired air mass flow rate.

The controller 22 determines an adjusted firing rate as needed to maintain boiler load at the set point boiler pressure and uses that adjusted firing rate in controlling the fuel flow control device 24. The controller 22 determines the fuel mass flow rate required to meet the adjusted firing rate and resets the fuel mass flow rate set point, $m_{fsp}$, to that required fuel mass flow rate. The fuel mass flow rate controller 62 in response to the setpoint of fuel mass flow rate and the sensed fuel mass flow rate determined the fuel servo position, $u_f$, in the manner discussed hereinbefore with respect to the fuel flow control feedback loop 60. The controller 22 repositions the fuel flow control 24 to the desired fuel servo position, $u_f$, which adjusts the fuel mass flow rate to the burner 4.

The controller 22 also uses the adjusted firing rate in controlling the air flow control device 26. The controller 22 references the air/fuel mass flow ratio map 50 programmed into the controller to select the air mass flow rate set point, $m_{asp}$, associated with the reset fuel mass flow rate set point, $m_{fsp}$. If the control system 20 includes a carbon monoxide/oxygen trim control feedback loop 40, as in the exemplary embodiment depicted in FIG. 2, the adjusted firing rate used by the controller 22 in selecting the desired air servo position, $u_a$, is further adjusted at an addition circuit 48 in response to a carbon monoxide/oxygen trim signal 47. The carbon monoxide/oxygen trim controller 44 generates the trim signal 47 based upon an error signal 45, for example by applying a PID function to the error signal 45. The error signal 45 is output from the negative feedback circuit 42 which receives as input a signal 43*a*, 43*b* (shown in FIGS. 4 and 5) indicative, respectively, of the sensed excess carbon monoxide and oxygen content and a signal 47*a*, 47*b* (shown in FIGS. 4 and 5) indicative, respectively, of a set point carbon monoxide content and a set point excess oxygen content for the adjusted firing rate selected by the controller 22 via reference to the excess oxygen target curve, $f_2$ (x), which as noted previously is a function of firing rate. The air mass flow rate controller 72 in response to the reset set point air mass flow rate and the sensed air mass flow rate determines the air servo position, $u_a$, in the manner discussed hereinbefore with respect to the air flow control feedback loop 70. The controller 22 then repositions the air flow control 26 to the selected air servo position, $u_a$, which changes the air mass flow rate to the burner 24.

Figure 3:
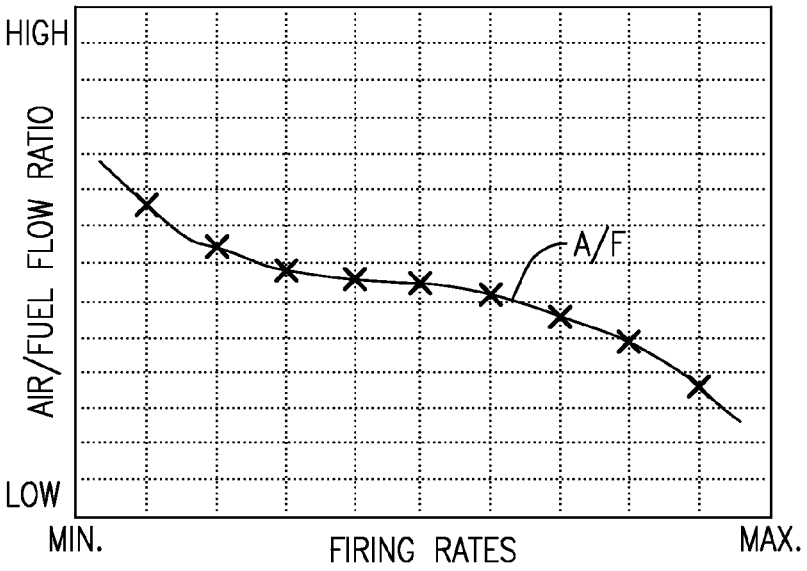
FIG. 3 is a graphical illustration of a map of an exemplary air to fuel (air/fuel) relationship to firing rate.

Referring now to FIG. 3, the air/fuel mass flow ratio map 50 comprises a non-linear curve A/F of selected air/fuel mass flow ratios versus firing rate from a minimum firing rate to a maximum firing rate. As noted previously, in the conventional practice of setting up a metered combustion control system, the technician conducts the commissioning of the combustion control system using a trial and error process to select the "optimum" air/fuel mass flow ratio at each of several firing rates between the minimum firing rate and the maximum firing rate. The non-linear curve A/F is derived from this set of "optimum" air/fuel mass flow ratios developed during the commissioning process.

A set point air mass flow to fuel mass flow (air/fuel) ratio for each firing rate is found through setting the servo position of one of the fuel flow control device 24 or the air flow control device, i.e. the damper 26 and the variable frequency drive 14 associated with the fan 8, at a selected position at each of a plurality of selected firing rates in a burner operating range between a minimum firing rate (the lowest firing rate at which combustion can be sustained) and a maximum firing rate (the firing rate at maximum allowed power output) and then manipulating the other of the fuel flow control device or the air flow control device in steps for adjusting either the air flow or the fuel flow to the burner 4 such that the amount of excess oxygen in the exhaust stack flue gas is maintained at the target excess oxygen level. The target excess oxygen level represents the combustion conditions at which the concentration of carbon monoxide in the exhaust stack flue gas is between a lower limit target level and an upper limit target level. Typically, other undesirable emissions, such as oxides of nitrogen, will also be at or near a minimum level at the target excess oxygen level.

In an embodiment of the automated setup method disclosed herein, the process of developing the map 50 of the air/fuel flow ratio setpoints is conducted with first selecting the fuel flow setpoints for the selected firing rates and then applying the automated setup method disclosed herein to determine the optimum air flow setpoint at each of the selected firing rates. The technician performing the commissioning task needs to manually define an ignition point firing rate and selects a number of other firing rates within the operating range at which a set of air/fuel flow ratios will be determined. In the discussion that follows, the ignition point firing rate is selected to be larger than the minimum firing rate, although it is to be understood that the ignition point firing rate could also be considered the minimum firing rate. After the ignition point is defined by the technician, the air servo and fuel servo position at the ignition point are known. Then, turning on the burner at the ignition point, the controller 22 adjusts then adjusts the air servo position in a stepped manner, for example in 5% air mass flow increase steps. After an initial delay for combustion to stabilize whereby the concentration of oxygen and carbon monoxide in the flue gas will have reached steady state values, the air mass flow, the excess oxygen content in the flue gas and the carbon monoxide content in the flue gas are measured, recorded against the air/fuel ratio at the air mass flow and fuel mass flow the associated ignition point firing rate, and saved. The changes in air mass flow, oxygen content and carbon monoxide content between air servo positions are calculated and used in identify the models for the transfer function $G_a$ relating air servo position to air mass flow, for air servo position to oxygen content and for air servo position to carbon monoxide content and to calculate the PID controller parameters for the air mass flow feedback loop controller $K_a$, and for the carbon monoxide/oxygen trim controller $K_2$.

The controller 22 next returns the air servo to its initial position at the ignition firing rate and adjusts the fuel servo position in a stepped manner, for example in 5% fuel mass flow decrease steps. After an initial delay for combustion to stabilize, the fuel mass flow is measured, recorded against the fuel servo position, and saved. The changes in fuel mass flow between fuel servo positions are calculated and used in identify the model for the transfer function $G_f$ relating fuel servo position to fuel mass flow, and to calculate the PID controller parameters for the fuel mass flow feedback loop controller $K_f$. The controller 22 returns the fuel servo to its position at the ignition firing rate.

Figure 4:
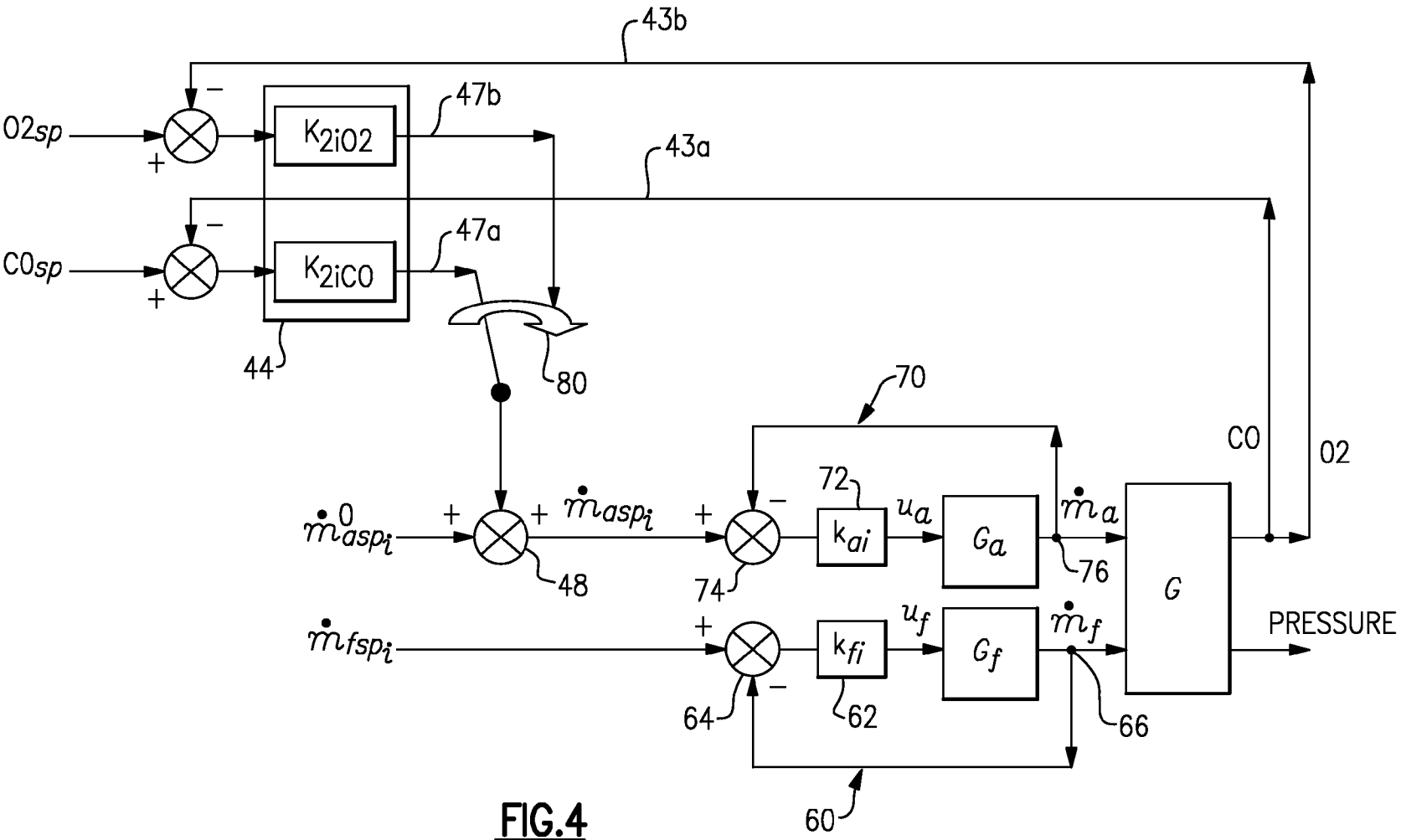
FIG. 4 is a block diagram of an exemplary embodiment of a feedback control method for identifying the optimal air mass flow at one selected firing rate at a selected fuel flow rate.

The controller 22 will calculate the fuel flow setpoint at the minimum firing rate (next point to the ignition firing rate) from the burner turndown ratio, and calculate an initial air flow setpoint at the minimum firing rate based on the stoichiometric point for the calculated fuel flow setpoint at the minimum firing rate and an excess oxygen content of 5%. Then, the controller 22 first turns on the fuel flow controller by changing its setpoint to the calculated initial fuel flow setpoint and then turns on the air flow controller by changing its setpoint to the calculated air flow setpoint at the minimum flow rate, because the fuel flow at the minimum firing rate is smaller than that at the ignition point and it is necessary to reduce the fuel flow first and then reduce the air flow. Then turn on the CO trim controller 44 shown in FIG. 4 to attain a carbon monoxide upper limit target level, such as for example 50 parts per million (ppm) CO in the flue gas, and to attain a lower limit target level, such as 2 ppm CO in the flue gas. A closed-loop negative feedback method using the PID control routine, such as depicted in block diagram in FIG. 4, initially tuned at the ignition firing rate as discussed above, may be applied to simplify reaching the lower limit and upper limit target values for carbon monoxide in the flue gas. At each of these target points, the corresponding air mass flows, air servo positions, and excess oxygen content are measured and recorded. The air mass flow at the lower limit target level for carbon monoxide corresponds to a maximum air mass flow rate at the minimum firing rate and the air mass flow at the upper limit target level for carbon monoxide corresponds to a minimum air mass flow at the minimum firing rate. Thus, the air mass flow setpoint at the minimum firing rate is calculated by averaging the respective air mass flows at the lower limit target level for carbon monoxide and at the upper limit target level for carbon monoxide. As illustrated in FIG. 4, in the event that the excess oxygen content in the flue gas drops below a predefined safety margin, for example below 0.5%, during the course of attaining the lower limit target level for carbon monoxide, the controller 44 will be switched from the carbon monoxide control loop to the oxygen trim control loop. Then, the minimum air flow setpoint is the air flow measured when the excess oxygen in the flue gas reaches at 0.5% by the O2 trim controller $K_{2O2}$.

The data from air servo position to air mass flow in the above procedure may be used to identify the air flow loop model parameters at the minimum firing rate point and to update the PID control parameters for the air servo position to air mass flow control loop. Additionally, the fuel servo position to fuel mass flow may be used to update the fuel flow loop model parameters and to update the PID control parameters for the fuel servo position to fuel mass flow control loop.

Having completed the process at the minimum firing rate, the controller 22 repeats the process discussed in above at paragraphs 0029 and 0030, at each of the selected firing rate points between the minimum firing rate and the maximum firing rate. When moving from a smaller firing rate to a larger firing rate, it is necessary to turn on the air flow control loop first and then turn on the fuel flow control loop in order to guarantee excess air for combustion. The process employed at each of the selected firing rates as described hereinbefore is illustrated in the block diagram represented in FIG. 4. The air mass flow at the lower limit target level for carbon monoxide corresponds to a maximum air mass flow rate at the selected firing rate and the air mass flow at the upper limit target level for carbon monoxide corresponds to a minimum air mass flow at the selected firing rate. The fuel mass flow set point, $m_{fspi}$, for the selected firing rate is calculated based on the turndown ratio. The air mass flow set point, $m_{aspi}$, at the selected firing rate is calculated by averaging the respective air mass flows at the lower limit target level for carbon monoxide and at the upper limit target level for carbon monoxide at that firing rate. Additionally, the parameters of the air mass flow controller, the fuel mass flow controller, the oxygen trim controller $K_{2O2}$ and the carbon monoxide $K_{2CO}$ trim controller are calculated for each selected firing rate. Thus, tuning of the controllers $K_{2O2}$ and $K_{2CO}$ in the carbon monoxide/oxygen trim controller 44 occurs during the course of the commissioning process rather than after the commissioning process in completed.

Figure 5:
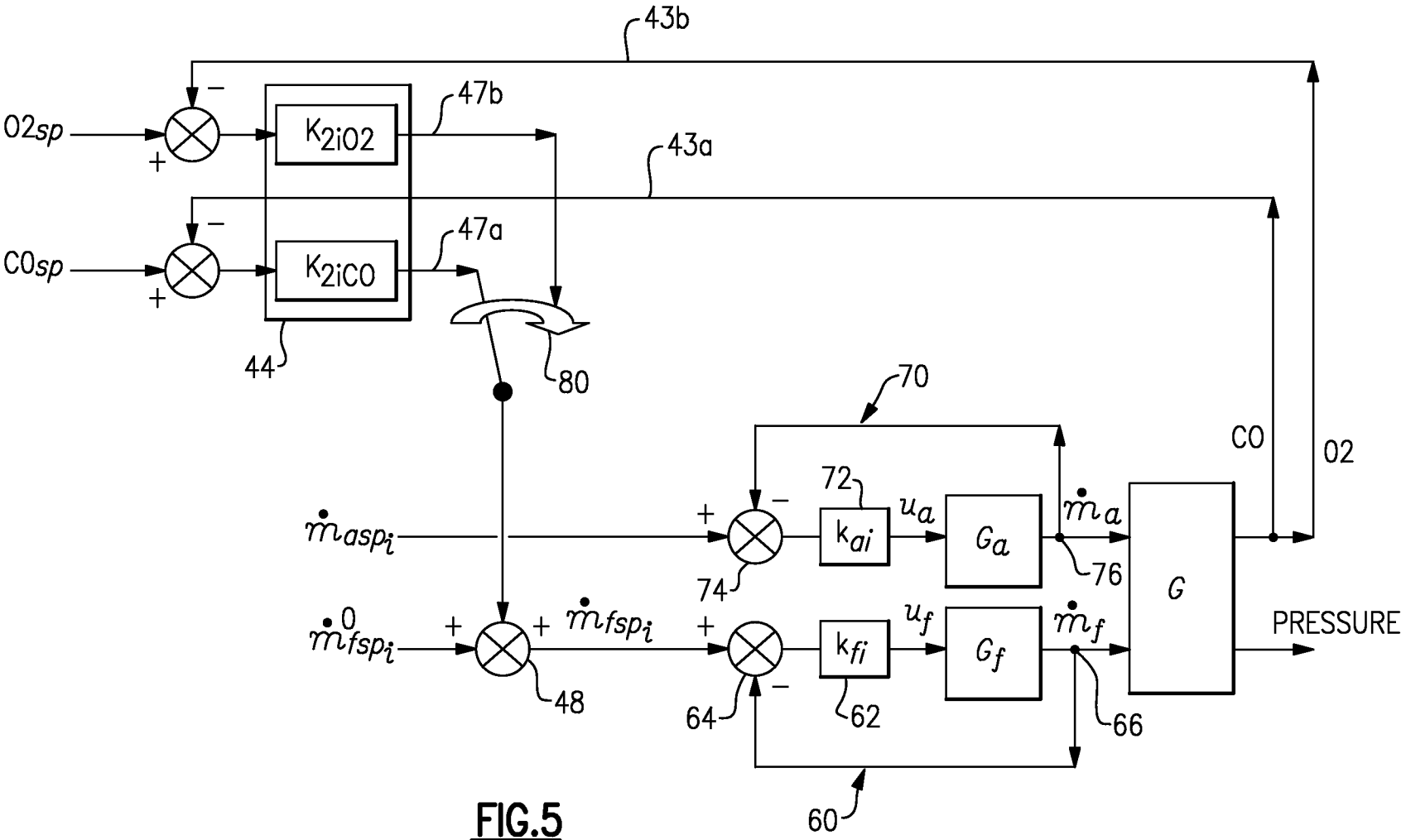
FIG. 5 is a block diagram of an exemplary embodiment of a feedback control method for identifying the optimal fuel mass flow at one selected firing rate at a selected air flow mass rate.

In the exemplary embodiment of the automated setup method discussed in detail hereinbefore, the process of identifying the optimal air/fuel mass flow ratio map 50 over a plurality of firing rate points includes setting the fuel flow device controller at a selected fixed setting associated with the selected firing rate point and then manipulating the air flow control device in steps to adjust the air mass flow rate to the burner using a negative feedback control loop acting on the air mass flow rate control device controller as illustrated in FIG. 4. However, as noted hereinbefore, the process of identifying the optimal air/fuel mass flow ratio map 50 over a plurality of firing rate points may instead include setting the air flow control device controller at a selected fixed setting associated with the selected firing rate point and then manipulating the fuel flow control device in steps to adjust the fuel mass flow rate to the burner using a negative feedback control loop acting on the fuel mass flow rate control device controller as illustrated in FIG. 5. As those skilled in the art will recognize, the operation of the feedback control loop when applied to adjusting the fuel mass flow rate as in FIG. 5 is similar to the operation of the feedback control loop when applied to adjusting the air mass flow rate as in FIG. 4 and as discussed hereinbefore, and is encompassed in the automated setup method discussed herein.

The method of commissioning a metered combustion control system of a steam/hot water boiler as disclosed herein provides a reliable iterative method to identify not only the air/fuel ratio map, but also to identify the models for air servo position to air mass flow, for air servo position to oxygen content and for air servo position to carbon monoxide content, as well as to calculate and tune the PID controller parameters for the air mass flow feedback loop controller $K_a$, the fuel mass flow feedback loop controller $K_f$, and for the controllers $K_{2O2}$ and $K_{2CO}$ in the carbon monoxide/oxygen trim controller 44.

The terminology used herein is for the purpose of description, not limitation. Specific structural and functional details disclosed herein are not to be interpreted as limiting, but merely as basis for teaching one skilled in the art to employ the present invention.

Although the invention has been described with reference to the exemplary embodiments depicted, it will be recognized by those skilled in the art that various modifications may be made without departing from the spirit and scope of the invention. Those skilled in the art will also recognize the equivalents that may be substituted for elements or steps described with reference to the exemplary embodiments disclosed herein without departing from the scope of the invention. Therefore, it is intended that the present disclosure not be limited to the particular embodiment(s) disclosed as, but that the disclosure will include all embodiments falling within the scope of the appended claims.

The invention claimed is:

1. A setup method for a metered combustion control system for controlling operation of a boiler combustion system having a burner, a fuel flow control device and a fuel flow control device controller operatively associated with said fuel flow control device for supplying fuel to said burner and an air flow control device and an air flow control device controller operatively associated with said air flow control device for supplying air to said burner, the method including defining a lower limit air/fuel mass flow ratio and an upper limit air/fuel mass flow ratio at a plurality of selected firing rate points between a minimum firing rate and a maximum firing rate, said setup method comprising:

(a) selecting a first firing rate point as a selected firing rate point;

(b) at an initial setting of the fuel flow control device controller associated with the selected firing rate point, selecting a first setting of the air flow control device controller and incrementally resetting the air flow control device controller;

(c) operating the burner at the selected firing rate point at each air flow control device controller setting in (b) to supply fuel to said burner and supply air to said burner to generate a flue gas and measuring at each air flow control device controller setting: the mass air flow, the oxygen content in the flue gas, and the carbon monoxide content in the flue gas;

(d) identifying at the selected firing rate point: a model relating: the air mass flow to the air flow control device controller setting, a model relating the oxygen content in the flue gas to the air flow control device controller setting, and a model relating the carbon monoxide content in the flue gas to the air flow control device controller setting;

(e) calculating a set of control parameters for an air mass flow rate feedback loop controller, for an oxygen trim feedback loop controller, and for a carbon monoxide trim feedback loop controller;

(f) resetting the air flow control device controller at the first setting and incrementally resetting the fuel flow control device controller;

(g) measuring the fuel mass flow at each fuel flow control device controller setting in (f) and identifying a model relating the fuel flow mass to the fuel flow control device controller setting;

(h) calculating a set of control parameters for a fuel mass flow rate feedback loop controller;

(i) selecting a new firing rate point as a further selected firing rate point;

(j) at an initial setting of the fuel flow control device controller associated with the further selected firing rate point, selecting a first setting of the air flow control device controller and incrementally resetting the air flow control device controller;

(k) operating the burner at the further selected firing rate point at each air flow control device controller setting in (b) to generate a flue gas and measuring at each air flow control device controller setting: the mass air flow, the oxygen content in the flue gas, and the carbon monoxide content in the flue gas;

(l) identifying and saving a lower limit air/fuel ratio at the further selected firing rate point at which the measured carbon monoxide content in the flue gas is equal to an upper limit carbon monoxide target level;

(m) identifying and saving an upper limit air/fuel ratio at the further selected firing rate point at which the measured carbon monoxide content in the flue gas is equal to a lower limit carbon monoxide target level;

(n) repeating (i) through (m) at a plurality of selected firing rate points between a minimum firing rate and a maximum firing rate; and (o) calculating a set point air/fuel ratio as the average of the lower limit air/fuel ratio and the upper limit air/fuel ratio at each selected firing rate point of the plurality of selected firing rate points and developing a relationship between the average air/fuel ratio and firing rate between the minimum firing rate and the maximum firing rate, the relationship between the average air/fuel ratio and firing rate between the minimum firing rate and the maximum firing rate being used for operating the boiler combustion system.

2. A method as recited in claim 1 wherein at (l) and (m) a negative feedback control loop is used to identifying the maximum and minimum air flow setpoint at each firing rate.

3. A method as recited in claim 2 wherein the negative feedback control loop comprises a carbon monoxide trim control loop.

4. A method as recited in claim 2 wherein the negative feedback control loop comprises an oxygen trim control loop.

5. A method as recited in claim 1 wherein at (l) and (m), the method includes selectively activating one of a negative feedback oxygen trim control and a negative feedback carbon monoxide trim control for use in identifying the maximum and minimum air flow setpoint at each firing rate.

* * * * *